US005379924A

United States Patent [19]

Taylor

[11] Patent Number: 5,379,924

[45] Date of Patent: Jan. 10, 1995

[54] AEROSOL CONTAINER CAP AND ACTIVATOR BUTTON ASSEMBLY

[76] Inventor: Brent Taylor, 119 W. Fourth, Hermann, Mo. 65041

[21] Appl. No.: 214,034

[22] Filed: Mar. 16, 1994

Related U.S. Application Data

[63] Continuation of Ser. No. 1,847, Jan. 8, 1993, abandoned.

[51] Int. Cl.[6] ..... B65D 83/22

[52] U.S. Cl. ..... 222/402.11; 222/402.13; 222/548

[58] Field of Search ..... 222/402.1, 402.11, 402.13, 222/519, 548

[56] References Cited

U.S. PATENT DOCUMENTS

| | | | |
|---|---|---|---|
| 2,762,536 | 9/1956 | Eriksen | 222/519 |
| 3,484,023 | 12/1969 | Meshberg | 222/402.11 |
| 4,044,922 | 8/1977 | Bordelon | 222/183 |
| 4,324,351 | 4/1982 | Meshberg | 222/402.11 |
| 4,434,914 | 3/1984 | Meshberg | 222/153 |
| 4,572,410 | 2/1986 | Brunet | 222/402.1 X |
| 4,582,228 | 4/1986 | Diamond et al. | 222/402.11 X |
| 4,620,646 | 11/1986 | Crasper | 222/402.11 X |
| 4,776,491 | 10/1980 | Nitta | 222/402.11 X |
| 4,848,595 | 7/1989 | Foster et al. | 220/402.11 X |

*Primary Examiner*—Andres Kashnikow
*Assistant Examiner*—Joseph A. Kaufman
*Attorney, Agent, or Firm*—Polster, Lieder, Woodruff & Lucchesi

[57] ABSTRACT

An aerosol container cap and activator button assembly is provided having a housing portion designed to mount on one end of an aerosol container with a tight friction fit. The housing has a bore therethrough defined by an interior wall with an activator button rotatably and slideably mounted within the bore. The activator button has a detent formed on the lower portion to engage the housing bore to keep the button secured within the housing. The button has a dispensing nozzle orifice formed therein as well as a positioning member formed on the top opposite the orifice to facilitate movement from a dispensing to a non-dispensing position. The assembly has positive stops to limit rotation of the button between the dispensing and non-dispensing positions.

8 Claims, 2 Drawing Sheets

AEROSOL CONTAINER CAP AND ACTIVATOR BUTTON ASSEMBLY

This application is a continuation of Ser. No. 08/001,842 filed Jan. 8, 1993, now abandoned.

BACKGROUND OF THE INVENTION

This invention relates to aerosol dispensers in general, and more particularly, to a cap and activator button dispensing assembly for use on an aerosol dispenser.

Aerosol dispensers are well known in the art and have been widely used since the early 1950s. Typically, an aerosol dispenser is a container or metal can containing a material under gaseous pressure. A valve stem extends out of the container from a valve connected to a dip tube that extends down into the can. Generally, a button or activator having a nozzle formed therein is mounted on the valve stem and downward pressure of the activator button opens the valve allowing dispensing of the material.

Generally the can is filled with the material to be sprayed and the propellant or compressed gas. The valve is normally held shut by the pressure in the can and by a spring directly below the valve stem. When a push-button or activator is pressed, it forces the valve stem down in its housing uncovering a small hole which leads up through the stem to a dispensing nozzle in the button or activator. This allows the product to be forced up the dip tube, through the valve and valve stem and out the nozzle by the gas pressure in the container. The nozzle can be shaped to give a spray or continuous stream or widely opened to allow dispensing of a foam or a viscous material. Aerosol dispensing cans have wide applications and are used in such diverse products as hairspray, deodorants, shaving cream, bug spray, paint, and even food products such as cheese spreads. One of the more recent uses for aerosol cans is for the dispensing of personal self-defense products, such as mace or red pepper spray. A small aerosol container of mace can be carried by an individual and used to spray the face and eyes of an assailant.

In most prior art aerosol dispenser assemblies, the push-button nozzle is simply a small, plastic cap with a dispensing orifice that is slipped onto the valve stem and held in place by friction fit. A cap or lid must be placed over the end of the container to cover the nozzle button. To use the container, the cap is removed to provide access to the button. The cap is necessary for storage or transport and to prevent accidental or unwanted discharge of the material due to accidental activation of the button. However, a container assembly having a separate lid is not acceptable for use on a dispenser for a personal protectant spray such as mace. Removal of the lid to reach the activator button would require extra time which is not available in an emergency situation. Furthermore, this type of nozzle does not provide for safety locking to prevent accidental discharge of the product. Therefore, it is an advantage to have a cap and activator assembly that does not require a separate, external cap or lid.

Several prior art devices have used a combination cap and button assembly to prevent accidental or unwanted operation of the button and discharge of material. For example, U.S. Pat. No. 3,484,023 to Meshberg, discloses a dispensing cap assembly comprising an outer housing which slideably supports a dispensing button which can rotate within the housing. When the dispensing button is moved to a dispensing position, the button can be depressed to activate the valve. When the button is moved to a closed position, the button cannot be depressed, thereby effectively preventing operation and discharge of material.

There are several notable disadvantages to this design. For example, there is no structure to retain the button portion within the housing. That is, during manufacture, the housing and button are molded separately. During assembly, the housing is mounted over the end of the aerosol container. The button portion is then heated by boiling in water and inserted into the housing so that the button portion seats on the valve stem. As the button portion cools, it contracts and is retained on the valve stem by a tight friction fit. This particular type of assembly is labor intensive and time consuming to assemble.

Furthermore, assemblies of the prior art type can fail during use. For example, the user must manipulate the button from a non-dispensing to a dispensing position. When the user exerts rotational pressure on the guide member or tab there is often an upward pressure exerted as well. This upward pressure of the thumb or finger can force the button off the valve stem and out of the housing. If the assembly is employed on a personal protectant spray can, for example, this failure can have disasterous consequences. Furthermore, prior art buttons can come apart in a pocket or handbag if the button portion is bumped, pushed or if the button is caught on another object during withdrawl from the handbag or pocket. Moreover, if the user tries to reattach or reassemble the button, the valve can be inadvertently activated and product discharged. Also, since the button portion is retained by friction, the force of this friction fit can sometimes be overcome by the propellant pressure as the material enters the button and nozzle for dispensing and the button portion can be forced off the valve stem and out of the surrounding housing, causing valve failure and product waste.

It is therefore an object of the invention is to provide an aerosol container cap and activator button assembly having a retention means for securing the activator button within the cap housing to prevent the button from being forced off the valve stem and out of the cap housing by the user or by aerosol pressure.

Another object of the present invention is to provide an aerosol container cap and activator button assembly wherein the cap housing portion is retained on the aerosol container and the button portion is mounted on the valve stem, yet retained in its position by a retention means holding it to the cap housing, thereby retaining the button on the valve stem by a positive retention means as well as by a friction fit.

It is another an object of the present invention to provide an aerosol container cap and activator button assembly that can be moved from an open to a closed position to prevent accidental discharge of the contents of the container.

Still another object of the present invention is to provide an aerosol container cap and activator button assembly that can be molded in two pieces but assembled prior to mounting on a container, thereby eliminating the step of heating and mounting the button portion separately.

A still further object of the invention is to provide an aerosol container cap and activator button assembly that is easy and economical to manufacture, requires a single step to attach to an aerosol container, and is well suited for its intended purposes.

SUMMARY OF THE INVENTION

Briefly stated, an aerosol container cap and activator button assembly is provided having a housing that is secured to the container and having a bore defined by an inner wall therethrough and an activator button rotatably and slideably mounted within the bore. The activator button portion of the assembly has a detent formed thereon to engage a lower surface of a housing bore-defining wall to keep the button secured within the housing and to keep the button positioned on or in the valve stem when subjected to upward pressure when rotated in use or from the contents of the container. The button has a dispensing nozzle orifice formed therein as well as a positioning member formed on the top of the button to facilitate movement from a dispensing to a non-dispensing position and vice versa. The assembly has positive stop means for limiting rotation of the button from a dispensing to a non-dispensing position.

DESCRIPTION OF A PREFERRED EMBODIMENT

Figure 1:
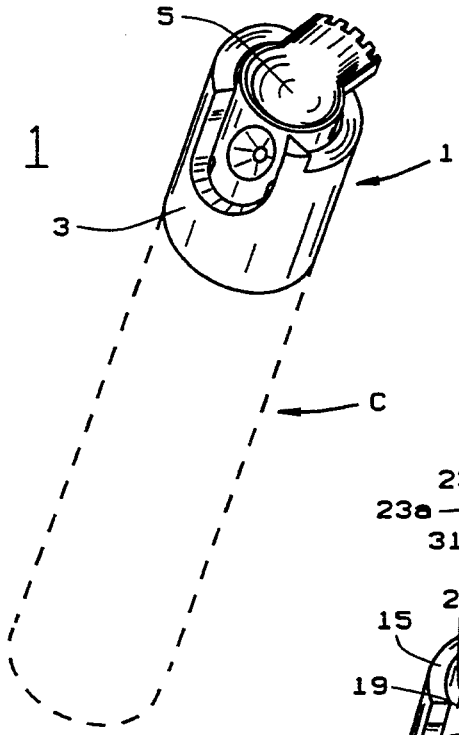
FIG. 1 is a perspective view of the aerosol cap and actuator button assembly of the present invention mounted on an aerosol container shown in phantom to illustrate environment.

An aerosol container cap and actuator button assembly of the present invention is shown generally as 1 in FIG. 1. The assembly is shown attached to an aerosol container C to demonstrate environment..

The assembly is comprised of two major components, a housing 3 and an actuator button 5. Housing 3 is secured over one end of container C and held in place by a tight friction fit, as will be further explained hereinafter, so that actuator button 5 seats on a valve stem V (FIG. 5) extending out of the end of container C.

Figure 2:
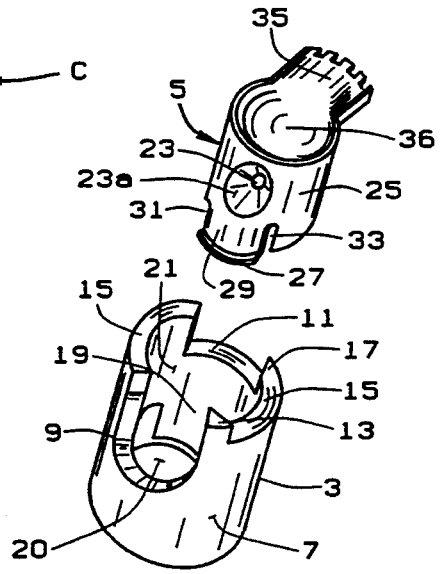
FIG. 2 is an exploded, perspective view of the aerosol cap and actuator button assembly of the present invention.

FIG. 2 illustrates each major component of the assembly in more detail. Housing 3 is shown as a generally cylindrical, hollow, open-ended structure having a double side wall made up of an outer wall or shell 7 and an inner wall 19, shorter in axial length than the outer wall 7. The walls 7 and 19 are connected at their upper edges by a bridging wall 15. Through one segment, the bridging wall 15 is recessed in steps, to provide a button recess 11 and a positioning surface 17. Diametrically opposite the button recess 11, the bridging wall forms a relatively deep, U-shaped orifice opening 9 . The stepped surfaces 11 and 17 of the bridging wall 15 accommodate a positioning member of an actuator button, permitting vertical movement of the actuator button positioning member in the recess 11 and allowing that member to slide along surface 17 toward and away from the button recess 11. In the particular embodiment illustrated in FIGS. 1–12, a positive stop 13 is formed at one extreme edge of recessed surface 17. An inner surface of wall 7 defines an interior bore 20 and the second interior cylindrical wall 19 defines a second, innermost bore 21. The function and relationship of the various components of housing 3 will be discussed in further detail hereinafter. Housing 3 is constructed from any appropriate material such as molded plastic.

The actuator button component 5, as shown, is also generally cylindrical in shape and molded from the same material as housing 3. The button 5 includes a cylindrical side wall 25, a downwardly concave top wall 36 and a positioning member 35. A dispensing nozzle orifice 23, surrounded by conical wall **23*a*, is formed in the face of wall 25. Wall 25 is of such size and dimension so as to fit within second bore 21, and able to rotate axially and slide downwardly within bore 21. Wall 25 has an axially downwardly extending flexible segment 29, in the embodiment shown, below the orifice 23. Parallel, axially extending slots 31 and 33, opening through the lower edge of the wall 25 on either side of the segment 29, allows segment 29 to flex inwardly slightly upon assembly so that button 5 can be inserted into its proper position within bore 21. A detent 27 is formed on and extends outwardly from the lower edge of segment 29. The resilient flexible nature of the button material permits segment 29 to return to its preformed position with detent 27 projecting under and engaging a lower radial surface of a cut-out or notch 19*a* in the bottom edge of the interior wall 19 of housing 3 as will be further explained below. The positioning member 35 is integral with the top wall 36 and side wall 25 opposite orifice 23 and projects radially beyond the side wall 25. The positioning member is of a width to fit slideably within the button recess 11 when the button is depressed and is of a thickness to permit it to clear and slide along the upper surface of the positioning recess when the button is in its uppermost position. The positioning member has a serrated or crenelated outer edge and, with the concave top wall 36, is designed and configured to accommodate a user's finger or thumb so that button 5** can be easily manipulated to rotate and depress the button.

Figure 3:
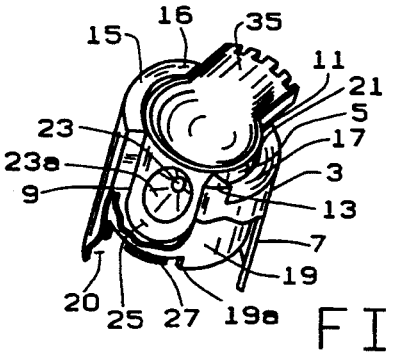
FIG. 3 is an enlarged, partial cut-away perspective view of the aerosol cap and actuator button assembly of the present invention, as showing the detent means.

FIG. 3 illustrates the relationship of the various elements of housing 3 and actuator button 5 when assembled. Button 5 is seated within bore 21. In this particular illustration, button 5 is rotated so that orifice 23 is aligned with orifice opening 9. Positioning member 35 rests upon recessed surface 17 and can be manipulated so that member 35 is aligned opposite opening 9 to bring orifice 23 in alignment within opening 9, placing the assembly in the "open" position. Positioning member 35 abuts positive stop 13 limiting rotation of button 5 in the open position. Detent 27 projects under the interior cylindrical wall 19 at cut-out 19*a*. This arrangement serves two purposes: first, detent 27 engages cut-out 19*a* to keep button 5 secured inside bore 21; second, recess 19*a* extends across the base of wall 19 so as to allow detent 27 to move within recess 19*a* a sufficient distance to allow positioning member 35 to abut positive stop 13. In that position, orifice 23 moves away from orifice opening 9 and recedes behind wall 7 effectively sealing the container in a "closed" position.

Figure 13:
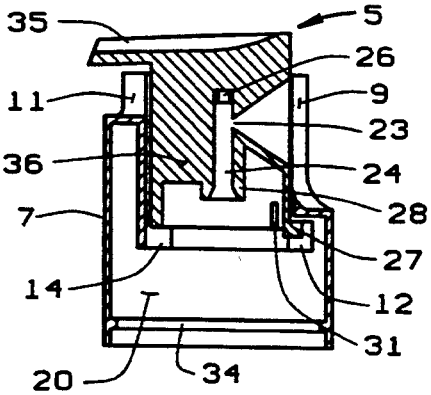
FIG. 13 is a cross-sectional view of an alternative embodiment of the aerosol container cap and actuator button assembly of the present invention.
Figure 14:
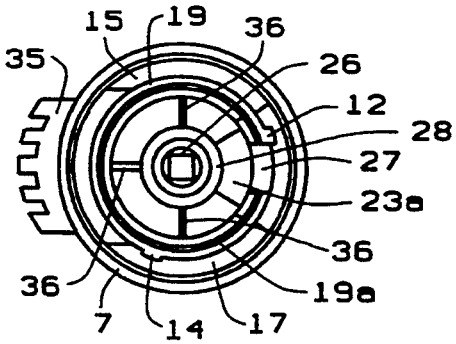
FIG. 14 is a bottom plan view of the aerosol container cap and actuator button assembly of the embodiment of this invention shown in FIG. 13.

It should be noted at this point that in an alternative embodiment, as illustrated in FIGS. 13 and 14, positive stops 12 and 14 are formed on the extreme ends of recess 19*a* so that detent 27 can abut stop 12 when orifice 23 is aligned within orifice opening 9 in the open position and abut stop 14 when button 5 is rotated to a position whereby orifice 23 recedes behind wall 7 in the closed position.

Figure 4:
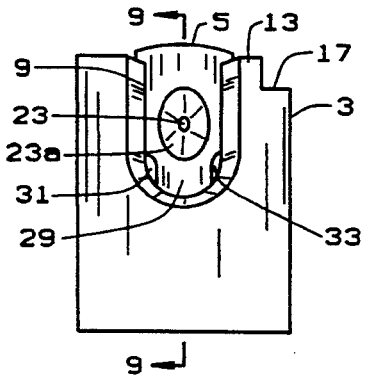
FIG. 4 is a front plan of the aerosol cap and actuator button assembly of the present invention in an open position.
Figure 5:
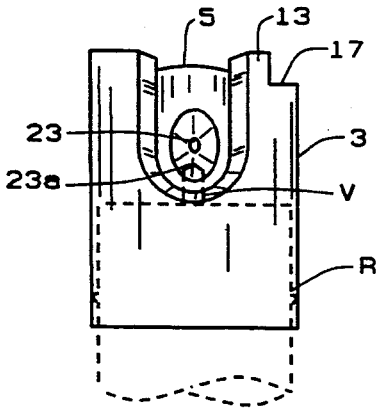
FIG. 5 is a front plan of the aerosol cap and actuator button assembly of the present invention, the actuator button depressed as in use.

Turning now to a discussion of the relative positions and functions of the elements of the assembly previously described as best illustrated in FIGS. 4–12, FIGS. 4–6 demonstrate the relationship of the external elements of the housing and actuator button in use. As stated above, actuator button 5 is both rotatably and slideably secured within housing 3. In FIG. 4, button 5 is rotated so that orifice 23 is aligned with orifice opening 9 and ready for activation. FIG. 5 illustrates the relationship between housing 3 and button 5 when the button is depressed also depressing valve stem V so as to open the valve and allow discharge of material through orifice 23 and orifice opening 9.

Figure 6:
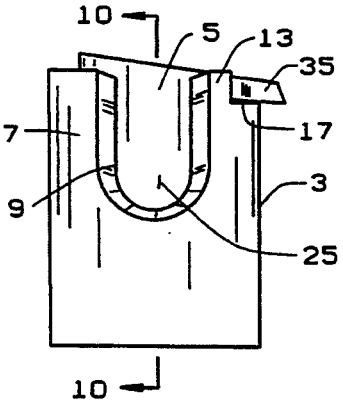
FIG. 6 is a front plan of the aerosol cap and actuator button assembly of the present invention in a closed position.

FIG. 6 illustrates button 5 rotated to a "closed" position. As previously explained, orifice 23 recedes behind wall 7. Positioning member 35 abuts positive stop 13 to limit rotation and engages recessed surface 17 so as to effectively block the downward movement of button 5 within the bore to prevent activation or accidental discharge of material from the container.

Figure 7:
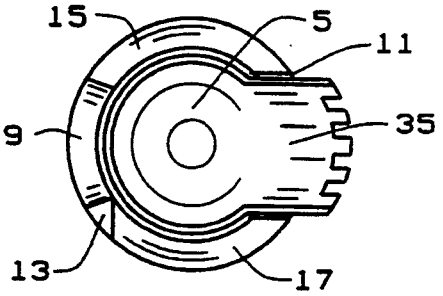
FIG. 7 is a top plan view of the aerosol cap and actuator button assembly of the present invention in the open position.
Figure 8:
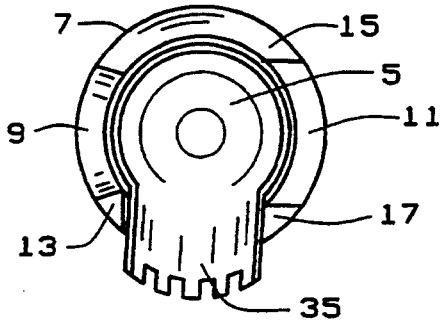
FIG. 8 is a top plan view of the aerosol can and actuator button assembly of the present invention in the closed position.

FIGS. 7 and 8 also illustrate the relative position of the positioning member 35 in both the "open" and "closed" position. In the open position (FIG. 7) positioning member 35 is aligned over button recess 11 and orifice 23 (not shown) is aligned within orifice opening 9. During activation or use, positioning member 35 is forced down within recess 11 allowing button 5 to slide down into bore 21 to activate the valve (not shown). In a closed position (FIG. 8), positioning member 35 slides across recess surface 17 and abuts positive stop 13. Orifice 23 (not shown) recedes behind wall 7 and is effectively covered. Since member 35 rests upon recessed surface 17, it is prevented from moving downwardly and thereby effectively blocks the activation of the valve and unwanted discharge of the material.

Figure 9:
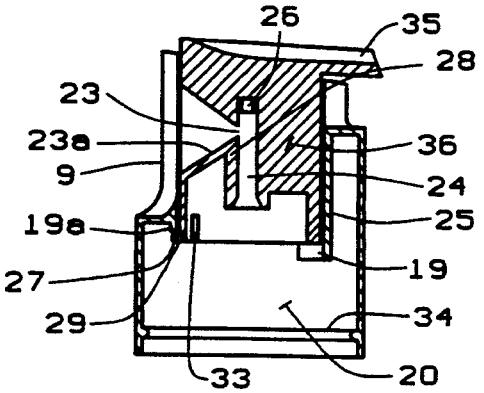
FIG. 9 is a cross-sectional view of the aerosol cap and actuator button assembly of the present invention taken along line 9—9 of FIG. 4.
Figure 10:
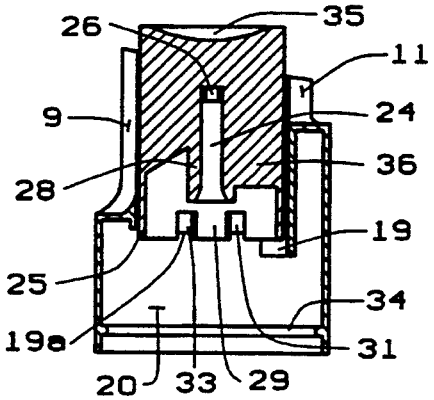
FIG. 10 is a cross-sectional view of the aerosol cap and actuator button assembly of the present invention taken along 10—10 of FIG. 6.

FIGS. 9 and 10 illustrate the relative positions of the internal structural elements of the activator button and cap assembly of the present invention. In FIG. 9, orifice 23, surrounded by conical wall 23*a*, is aligned within orifice opening 9. Orifice 23 is cooperatively connected to and opens into valve stem cavity 24 formed centrally within button 5. Cavity 24 is defined by a squared top wall 26 and depending columnar wall 28. When the assembly is mounted on an end of a container (FIG. 5), a valve stem V extending out of the end of the container seats within cavity 24 and abuts square wall 26 and is secured within cavity 24 by a tight friction fit. As previously explained, detent 27 formed on and extending outward from wall segment 29 engages the surface of interior wall recess 19*a* to further secure button 5 in place on the valve stem. When button 5 is forced downward within bore 21 during use, square wall 26 exerts a downward pressure on the valve stem V to open the valve and allow the contents of the container, which is under pressure, to be forced out through the valve stem through cavity 24 and out through cooperating orifice 23.

FIG. 10 illustrates the relative positions of the elements of the assembly in a closed position. As shown, when button 5 is rotated to this position, there is no cooperative opening between cavity 24 and orifice opening 9.

Figure 11:
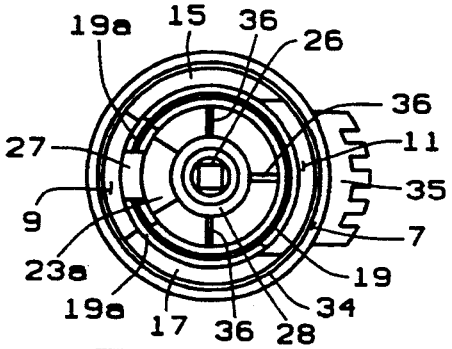
FIG. 11 is a button plan of the aerosol cap and actuator button assembly of the present invention in an open position.
Figure 12:
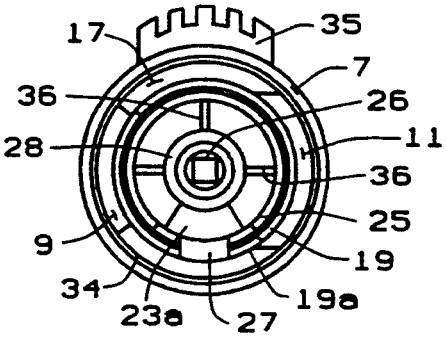
FIG. 12 is a bottom plan aerosol container cap and actuator button assembly of the present invention in a closed position.

FIGS. 11 and 12 further illustrate the elements of the assembly in both the open and closed positions. In FIG. 11, conical wall 23*a* which surrounds orifice opening 23 is aligned with orifice opening 9. Also disclosed in FIG. 11 are support ribs 36 which extend inwardly from button side wall 25 to columnar wall 28 and square wall 26 to add rigidity and stability to both of those walls. In both the open and closed positions, detent 27 is secured under recess 19*a* of internal wall 19. Detent 27 can slide along a surface of recess 19*a* to permit rotation from the open to the closed position. As previously stated, in a second embodiment of the assembly (FIGS. 13 and 14), positive stops 12 and 14 are formed on each extreme end of recess 19*a* so as to engage detent 27 and limit rotation between the open and closed positions.

During the mounting of the cap and actuator button on an aerosol container, the assembly is positioned over one end of an aerosol container with the valve stem V (FIG. 5) extending therefrom. The actuator button cavity 24 is positioned over valve stem V and the assembly is secured on the end of the container by exerting firm downward pressure. In both embodiments, ring 34, formed on the interior circumference of wall 7, seats over a raised area or rim R (FIG. 5) on the container surface so as to retain the assembly in place.

It will be obvious to those skilled in the art that various changes and modifications of the embodiments as described and illustrated in the drawings can be made without departing from the scope of the invention. Therefore, the foregoing description and accompanying drawings are intended for illustrative purposes only and are not to be construed in a limiting sense.

What is claimed:

1. In an aerosol container having a container body and a valve for controlling the dispensing of material under pressure from the container, a cap and activator button assembly for activating the valve comprising:

a housing having means thereon for securing said housing to an end of the container, said housing having an outer wall and an inner wall with a bore defined by said inner wall extending therethrough;

an activator button within said bore having an orifice formed therein and a positioning member opposite said orifice and extending therefrom to facilitate the rotation and movement of said button within said housing between a dispensing an non-dispensing position, said button having an axially downwardly extending flexible segment; and a detent formed on said flexible segment to rotatably and slideably engage under a lower radial surface of said inner wall of said housing thereby securing said button within said housing during assembly and during use.

2. The assembly of claim 1 wherein said housing has stop means formed on a bridging wall between said outer and inner walls and disposed to engage said positioning member for limiting movement of said button in said dispensing and in said non-dispensing positions.

3. In an aerosol container a dispensing cap and valve actuating assembly comprising:

a housing having an outer and an inner wall, means on said outer wall for securing said housing to an end of an aerosol container and a bore defined by said inner wall extending therethrough;

an activator button within said bore having an orifice formed therein for dispensing the contents of the container and a positioning member opposite said orifice and extending therefrom to facilitate the rotation and movement of said button within said housing between a dispensing and non-dispensing position; and a detent formed on an axially downwardly extending flexible segment of said activator button disposed to engage a lower radial surface of said inner wall of said housing thereby forming a positive retention means to retain said button within said housing during assembly and use; and a first stop means formed on said lower radial surface of said inner wall for engaging said detent for limiting rotational movement in said dispensing and non-dispensing positions.

4. The assembly of claim 3 wherein said housing has second stop means formed thereon engaging said positioning member for limiting movement in said dispensing and non-dispensing positions.

5. An aerosol container, comprising:

a container body having a valve for controlling the dispensing of material under pressure from the container;

a cap and activator button assembly for activating the valve, said assembly having a housing, said housing having means formed on an outer wall for securing said housing to an end of said container and having a bore defined by an inner wall extending therethrough;

an activator button within said bore having a dispensing orifice formed therein, a positioning member opposite said orifice and extending therefrom to facilitate the rotation and movement of said button within said housing between a dispensing and a non-dispensing position, and a downwardly extending flexible segment;

a first means for limiting rotation of said activator button in said positions, said first means formed on said housing and disposed to engage said positioning member;

a detent formed on said flexible segment extending under a lower radial surface of said inner wall to secure and retain said button within said housing.

6. The invention of claim 5 wherein said first means for limiting rotation in the dispensing and non-dispensing positions further comprises stop means formed on an upper surface said housing to engage said positioning member.

7. The invention of claim 5 further comprising a second means for limiting rotation in the dispensing and non-dispensing positions, said second means formed on said lower radial surface of said interior wall to engage said detent.

8. The invention of claim 7 wherein said housing has an internal annular raised means formed therein for securing said housing on said container body.

* * * * *